US010584833B2

(12) United States Patent
Horne et al.

(10) Patent No.: US 10,584,833 B2
(45) **Date of Patent: *Mar. 10, 2020**

(54) METHOD AND APPARATUS FOR CONTROLLING LIGHTING MODULES OF A MULTI-ELEMENT PORTABLE LIGHT

(71) Applicant: Alliance Sports Group, L.P., Fort Worth, TX (US)

(72) Inventors: Gregory Lee Horne, Euless, TX (US); Jimmy Prieto, Fort Worth, TX (US)

(73) Assignee: Alliance Sports Group, L.P., Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,159

(22) Filed: Apr. 15, 2019

(65) Prior Publication Data

US 2019/0293245 A1 Sep. 26, 2019

Related U.S. Application Data

(63) Continuation of application No. 15/916,433, filed on Mar. 9, 2018, now Pat. No. 10,260,688.

(Continued)

(51) Int. Cl.

*F21L 4/02* (2006.01)
*F21V 23/04* (2006.01)

(Continued)

(52) U.S. Cl.

CPC ..... *F21L 4/027* (2013.01); *F21V 13/04* (2013.01); *F21V 14/00* (2013.01); *F21V 23/0414* (2013.01); *F21Y 2113/00* (2013.01)

(58) Field of Classification Search

CPC ..... F21L 4/027; F21V 23/0414; F21V 13/04; F21V 14/00

See application file for complete search history.

(56) References Cited

U.S. PATENT DOCUMENTS 5,469,346 A 11/1995 Haut et al.
6,055,766 A 5/2000 Nolen et al.

(Continued)

FOREIGN PATENT DOCUMENTS

CN 204014833 U 12/2014
EP 2158141 B1 5/2013

(Continued)

OTHER PUBLICATIONS

International Search Report dated Jul. 12, 2018, in PCT Application No. PCT/US2018/021734, filed Mar. 9, 2018; 3 pages.

(Continued)

*Primary Examiner* — Thomas M Sember

(74) *Attorney, Agent, or Firm* — Thorpe North & Western LLP

(57) ABSTRACT

A lighting device having a first configuration wherein a first light source is exposed and a second light source is covered and a second configuration wherein the first light source is exposed and the second light source is exposed. The light device is enclosed in a rigid enclosure securing the lighting device in the second configuration. A power source is electrically coupled to the lighting device to provide power to the first light source and the second light source. A switch is coupled to the power source and the first and second light sources. The switch is configured to permit propagation of power from the power source to the second light source when the lighting device is in the second configuration.

20 Claims, 5 Drawing Sheets

Related U.S. Application Data

(60) Provisional application No. 62/469,788, filed on Mar. 10, 2017.

(51) Int. Cl.

| | |
|---|---|
| ***F21V 13/04*** | (2006.01) |
| ***F21V 14/00*** | (2018.01) |
| *F21Y 113/00* | (2016.01) |

(56) References Cited

U.S. PATENT DOCUMENTS

| | | | |
|---|---|---|---|
| 6,134,826 | A | 10/2000 | Mah |
| 7,360,921 | B1 | 4/2008 | Greenspon |
| 2006/0262526 | A1 | 11/2006 | Dubois |
| 2008/0034642 | A1 | 2/2008 | Chen |
| 2017/0002994 | A1 | 1/2017 | Fisher et al. |
| 2017/0094960 | A1 | 4/2017 | Sasaki et al. |

FOREIGN PATENT DOCUMENTS

| | | | |
|---|---|---|---|
| GB | 2540530 | A | 1/2017 |
| KR | 20-2013-0006888 | U | 12/2013 |
| KR | 101545083 | B1 | 8/2015 |
| KR | 10-1711395 | B1 | 3/2017 |

OTHER PUBLICATIONS

International Search Report dated Sep. 24, 2018, in International Application No. PCT/US18/35599, filed Jun. 1, 2018; 16 pages.

METHOD AND APPARATUS FOR CONTROLLING LIGHTING MODULES OF A MULTI-ELEMENT PORTABLE LIGHT

PRIORITY CLAIM

This application claims priority to application Ser. No. 62/469,788 filed on Mar. 10, 2017 and application Ser. No. 15/916,433 filed on Mar. 9, 2018, both entitled "Method and Apparatus for Controlling Lighting Modules of Multi-Element Portable Light" and which are incorporated herein by reference in its entirety.

FIELD OF THE TECHNOLOGY

This application relates to methods and apparatus for controlling the different light modes of portable lights. Specifically, it relates to switching operations when portable lighting devices are in different physical configurations and a fixed packaging.

BACKGROUND

The present invention relates generally to Light Emitting Diode (LED) lighting components, lamps, and luminaries or other light sources in various lighting applications, including lights with a forward directing light source and lights with a lateral directing light source. Flashlights having multiple lighting display settings or modes have been previously produced. A limitation with prior art flashlights is that in order to select a desired mode, a user must use two hands to manipulate the flashlight with one supporting the flashlight while the other adjusts an appropriate mode-activation switch, because the switch requires twisting or other manipulation or because multiple switches are utilized that require the user to move between such switches or the switch must be slid along a track to a plurality of different positions. This is particularly bothersome when a lighting device has multiple physical configurations and the user wishes to simplify operations of the device and/or test the device while inside its packaging.

DESCRIPTION OF EMBODIMENTS

Figure 1:
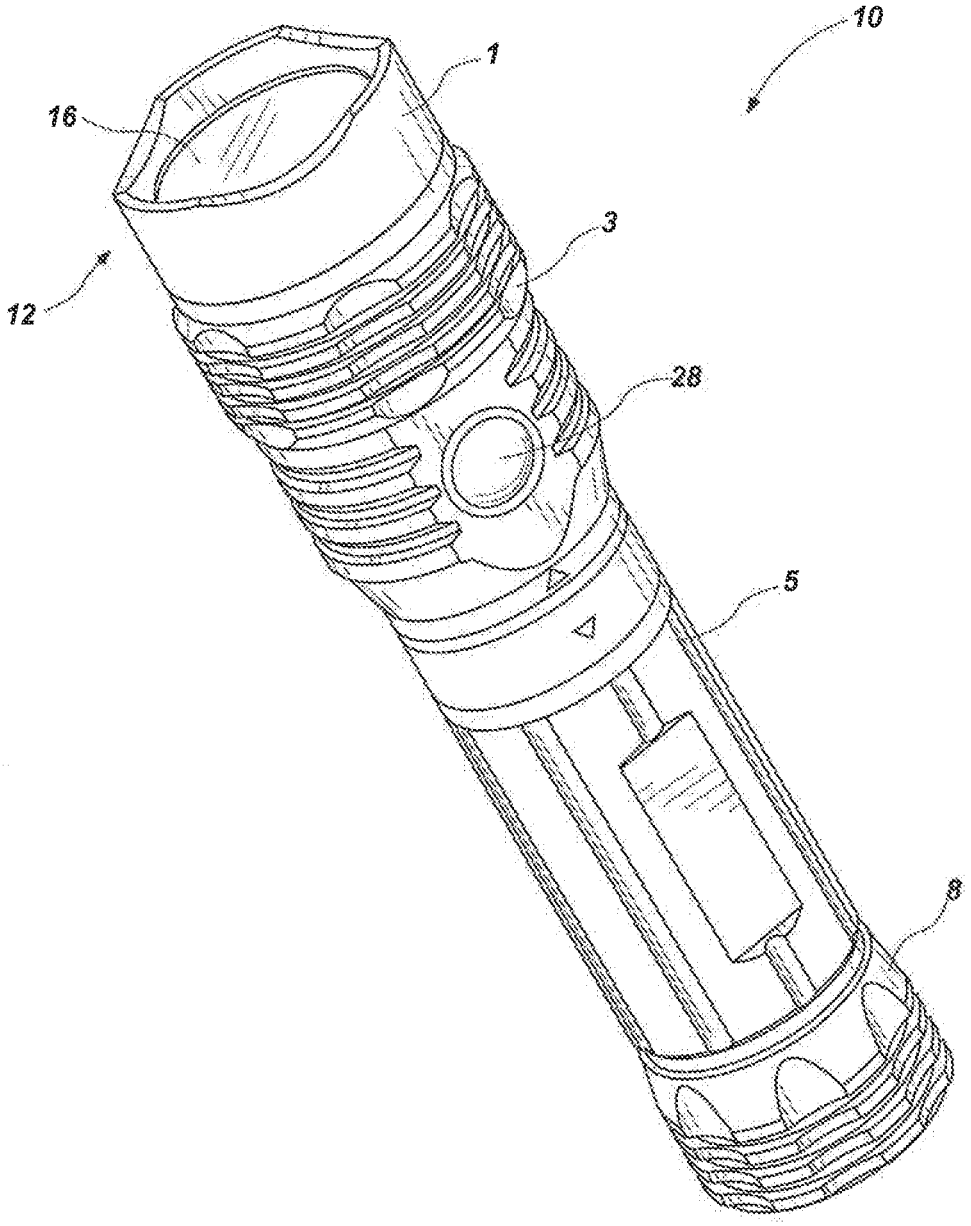
FIG. 1 is a perspective view of an extendable flashlight in a "closed" configuration in accordance with one aspect of the technology.

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

The term "flashlight" as used herein is used as an example of a lighting device that may employ the technology herein but should not be construed as limiting what kinds of lighting devices may employ the current technology. As such, the term flashlight should be broadly construed to include any hand-held lighting device, lanterns, headlamps, and other various devices that function, at least partially, to provide light for the user.

An initial overview of the technology is provided below and specific technology embodiments are then described in further detail. This initial summary is intended to aid readers in understanding the technology more quickly, but is not intended to identify key or essential features of the technology, nor is it intended to limit the scope of the claimed subject matter.

Broadly speaking, aspects of the current technology improve and make possible the packaging of products with a "TRY ME" feature that permits stepping through different lighting features available on a light product while the light product is in an "open" or "revealed" configuration. That is, certain work lights comprise a multi-position configuration wherein when the light is in a "closed" configuration, the flashlight appears to be a conventional flashlight (or other lighting device). However, the flashlight may be extended about a body of the light (for example) exposing an additional area or lateral light source. When the flashlight is in the closed configuration, the flashlight is configured such that the area light or lateral light cannot be activated thereby unnecessarily draining the flashlight's batteries. Certain products may use an auto-on feature when the area light or work light is revealed (i.e., the flashlight is in an extended or open configuration), therefore it cannot be packaged and displayed in the revealed orientation or it will consume the installed batteries. This is a limitation that can be overcome by removing the batteries during the packaging process, thus making the flashlight non-functional in the retail environment. In one aspect of the technology, a flashlight product is marketed in a package with a "TRY ME" feature. This means that the product must have the power source installed and active in order for the consumer to activate the light. Aspects of the present invention seek to overcome this problem through the use of electrical switches and a programmable logic control system permitting activation of aspects of the lighting device while in a fixed position inside product packaging.

Figure 2:
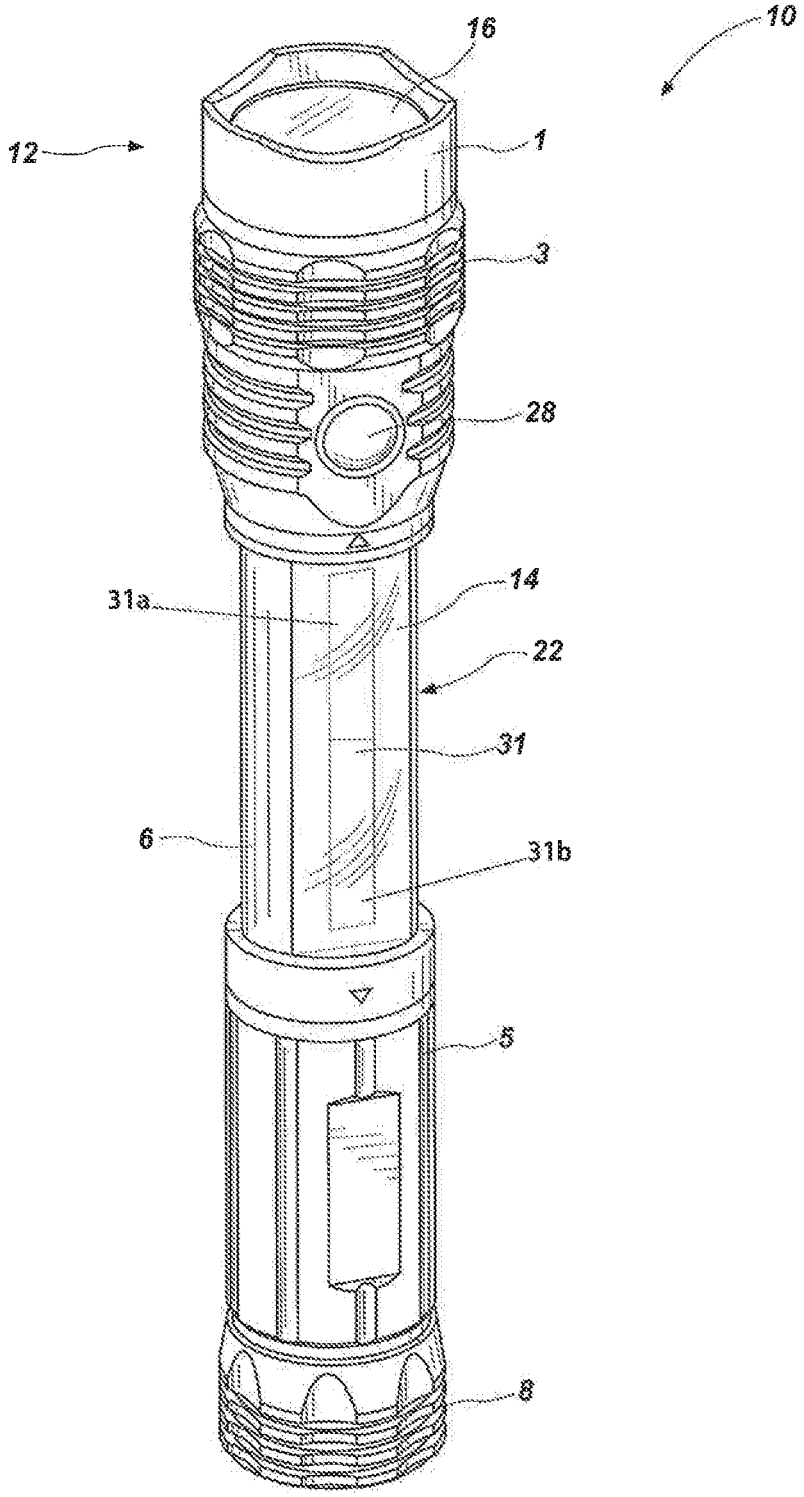
FIG. 2 is a side view of an extendable flashlight in an "open" configuration in accordance with one aspect of the technology.
Figure 3:
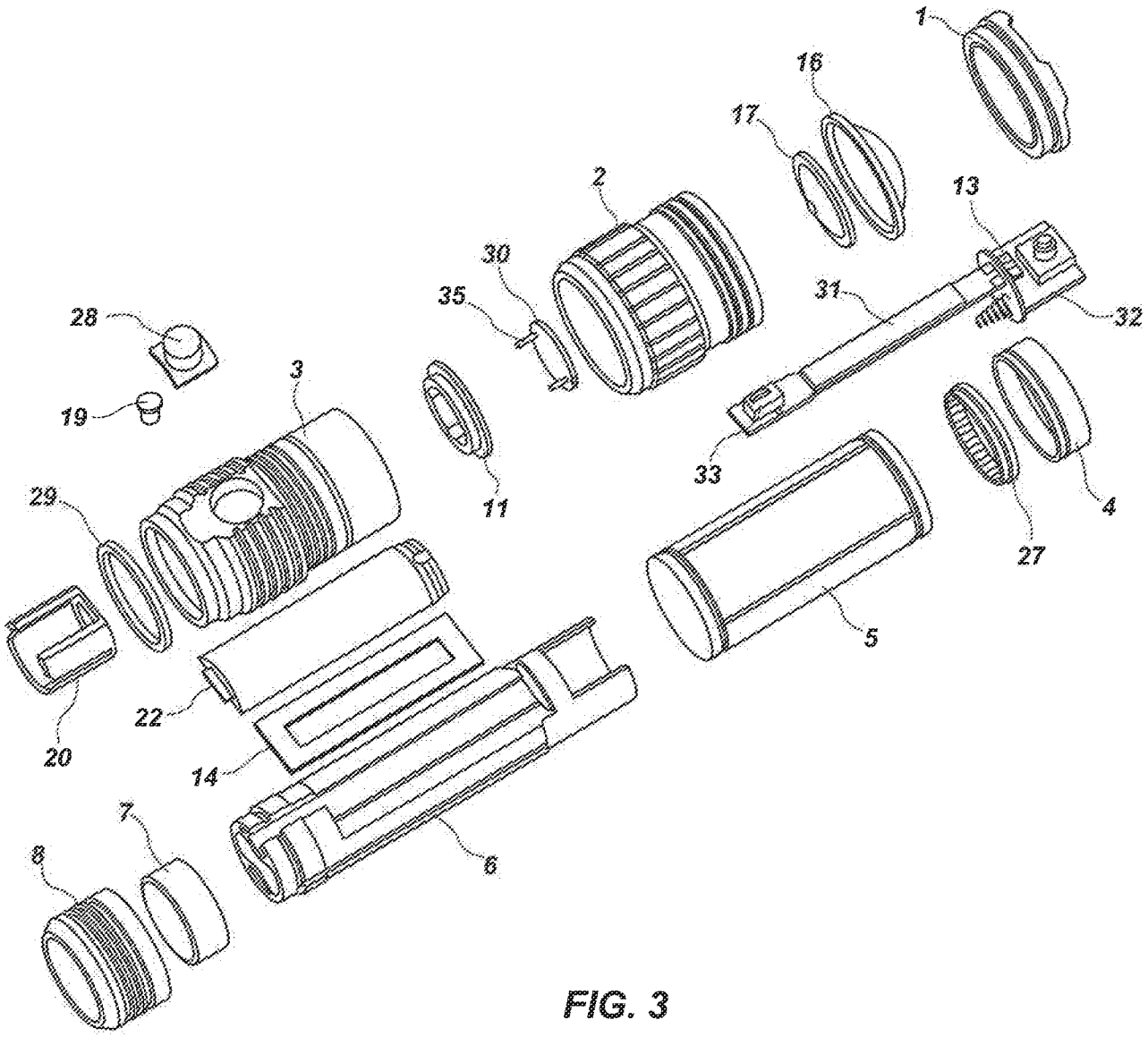
FIG. 3 as an exploded view of an extendable flashlight in accordance with one aspect of the technology.

With reference generally to FIGS. 1-3, one example of a lighting device that may employ the current technology is disclosed. The flashlight is generally shown at 10. In FIG. 1, the flashlight 10 is shown in a closed position wherein a first housing or shroud 5 comprises a cavity that encloses a first light source 31 therein. The shroud or housing 5 is coupled to a second housing 3 which comprises, for example, a second (forward-directed) light source 30, a power source, and a plurality of switches controlling the operation of the lights sources 31 and 30 (or other light sources) disposed in flashlight 10. In the closed configuration, one of the plurality of light sources (in this case the forward-directed light source 30) is not covered while the light source 31 is covered. Meaning, the light source 30 is not blocked by an opaque covering while the light source 31 is. In this aspect, the light source that is covered when the flashlight 10 is in a closed configuration is positioned such that when the light source 31 is uncovered it is capable of emitting light in a direction that is lateral or normal to a longitudinal axis of the flashlight. In other aspects of the technology, however, the forward light source 30 may be covered with the flashlight is in a "closed" configuration and the light source 31 may be uncovered when in that same "closed" configuration.

FIG. 2 shows the flashlight of FIG. 1 in an extended or open position wherein the shroud 5 has been extended away from the second housing 3 thereby exposing the light source 31. The light source 31 is slidably mounted within the cavity of the shroud or housing 5 and is fixedly attached to a second housing 3. The light source 31 is incorporated into a housing that includes a power source (e.g., batteries) disposed within its interior. The power source is used to provide power to the plurality of light sources, including, in one aspect, the light source 31 as well as the forward-directed light source 30 emanating from the distal end 12 of the flashlight 10. Each of the plurality of light sources can be activated either together or independently by depressing the button 28. While a button 28 is specifically referenced, it is understood that any control mechanism may be used to activate the light sources through various switches (discussed further herein) disposed about the lighting device 10. A second housing 3 contains the forward-directed light source 30 and its attendant components (i.e., lens 16, LED 30, etc.). However, in one aspect of the technology the first light source 31 and the second light source may be located in the same housing. In one aspect of the technology, the flashlight 10 is converted from a closed configuration to an open configuration by moving the shroud 5 away from the second housing 3. However, the flashlight 10 may be converted into an open configuration from a closed configuration by any means whereby a light source that was covered in a first configuration is uncovered in a second configuration.

In accordance with one aspect of the technology, the operation of one or more light sources disposed about the flashlight 10 are controlled by switches. For example, in one aspect of the technology, one of the switches is a mechanical reveal switch. In a first position, the switch indicates to the programmable logic control system that the flashlight 10 (or other lighting device) is in a closed position, thus indicating that the non-revealed (or covered) lighting element should not be activated. In a second position, the switch will indicate to the control system that the flashlight 10 is in open (or extended) position, thus indicating that the lighting element (30, 31, etc.) is now revealed and may or may not be activated—depending on the activation of either software or logic controlled switches (S3) or the mechanical switch (e.g., S1, S2).

In one aspect of the technology, the flashlight 10 is packaged in a rigid or semi-rigid plastic package often referred to as a "clam-shell" or "blister" package. The term "rigid" means the package may not be moved without suffering plastic deformation. The term "semi-rigid" means that the package is firm and solid but not inflexible. The rigid or semi-rigid plastic package minimizes in-store theft of lighting products in that it is difficult to remove the lighting products from the packaging in order to hide the light in a pocket or bag. The packaging itself is cumbersome so that it likewise creates a disincentive to would-be thieves. In one aspect of the technology, the flashlight 10 is disposed within the clam-shell or blister package in an at least partially open configuration so that the potential purchaser can see at least a portion of the features of the flashlight 10 when it is in the open configuration. The flashlight 10 is packaged within the clam-shell 40 (or other packaging) in such a manner that the flashlight 10 cannot be placed in the closed configuration without first removing the flashlight 10 from the packaging or breaking the packaging. That is, in one aspect, the packaging 50 in connection with enclosure 40 encases the first housing 5 and second housing 3 in such a manner that two housings (3 and 5) cannot be substantially moved with respect to the other without first removing the flashlight 10 from the enclosure 40 or breaking the enclosure 40. While reference is made herein to plastic packaging and clam-shell or blister packaging, it is understood that other packaging may be used to accomplish the object of the current technology. For example, the package may comprise cardboard, paper, plastic, or any other rigid or semi-rigid material that creates a bigger volume around the flashlight dissuading shoplifting and also presenting the flashlight 10 (or other product) in a "TRY ME" configuration that allows the user to observe operation of the flashlight 10 when it is in its open configuration.

FIG. 3 discloses another example of a lighting device with similar (but not necessarily identical) structural features. Like numerals are used throughout the figures for like features. The lighting device is shown with its component parts exploded and comprises a first housing or shroud 5 that covers a light source/control assembly.

Generally speaking, the light source/control assembly comprises a light source 31 coupled to a secondary switch (S2) 33 and main switch (S1) 32 and a microprocessor controlled switch (S3) 13. The main switch 32 is operatively coupled to the main switch activator pin 19 that is covered by a silicone switch cover 28. The secondary switch 32 is housed within a support structure 20. The light source/control assembly is also operatively coupled to the forward-directed LED 30 by power leads 35. A heat sink 11 is coupled to LED 30. Forward-directed LED 30 passes light through the flashlight by way of LED reflector 17 and lens 16. A portion of the light source/control assembly is housed within support cylinder 6 which also comprises a cavity for the placement of batteries therein. A reflector 14 is placed on top of support cylinder 6 and about the periphery of light source 31. A lens 22 is placed on top of the reflector 14 and light source 31 to complete the cylindrical shape of the support 6. A proximal end of support 6 comprises a tail cap 7 which includes a battery circuit therein. The tail cap 7 and proximal end of support 6 are enclosed by an additional tail cap 8 having a magnetic base. While reference is made herein to batteries, it is understood that the flashlight may also be powered by a tethered cable.

A cylindrical slidable housing (or reveal shroud) 5 encloses the cylindrical support 6 and is configured such that the support 6 can be slid from the interior of the housing 5. A compressible friction washer 27 is disposed between the housing 5 and a threaded tension ring 4. A distal end of the flashlight comprises a cylindrical body 3 that supports the forward-directed LED 30 and its attendant components. A tactical bezel 1 is disposed about the distal end of a manual focus ring 2 which is also operatively coupled to cylindrical body 3.

As noted above, in marketing certain products, it is useful to build the intelligence or configuration of dependent switches into the portable lighting to be able to display or package the product in the configuration where the normally non-revealed element (when in a closed configuration) is revealed (i.e., when in an open configuration)—but not active. Certain products may use an auto-on feature when the element is revealed, therefore it cannot be packaged and displayed in the revealed (or open) orientation or it will consume the installed batteries. In one aspect of the technology, a flashlight 10 product is marketed with a "TRY ME" feature. This means that the flashlight 10 must have the power source installed and active. In one aspect, the flashlight 10 is equipped with a programmable processor. The software in the processor is configured such that the "TRY ME" feature will only allow any one of the plurality of lighting sources that are activated to remain in operation for only a short predetermined period (i.e. 6, 8, or 10 seconds, for example) if the user presses any of the mechanical operation buttons (S1), or if they extend the reveal shroud and activate the mechanical shroud switch (S2) to examine the elements that were normally not revealed. In this manner, the flashlight cannot be left on thereby draining the batteries.

In another aspect of the technology, the product is sealed within a package so the mechanical shroud is opened to the full reveal position when the product is packaged in order to successfully show the product's normally hidden lighting feature. In this case the "TRY ME" feature will not allow the automatic operation of revealed element, but would allow the user to momentarily activate the lighting modes by utilizing switch 32 (i.e. S1) to control the sequencing of S3 switches which would allow the activation of the now revealed element since S2 (via 33) is active.

Figure 4:
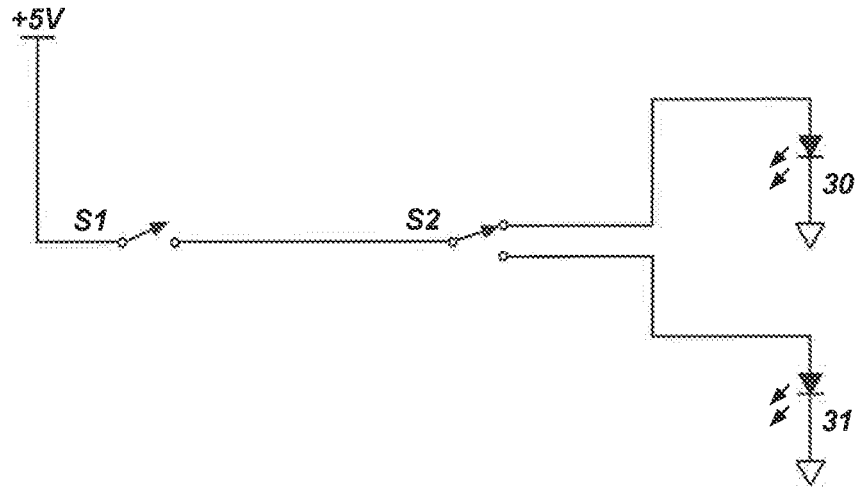
FIG. 4 is an electrical schematic of a system used in connection with a lighting device in accordance with one aspect of the technology.

FIG. 4 represents the cascade design in one aspect of the technology. Two mechanical switches 32 (S1) and 33 (S2), where S2 is dependent on S1 for power. S2 is the reveal mechanical switch but even if the shroud is opened to activate the reveal light, it will not activate unless S1 is active. Meaning, S2 is activated when the covered light is uncovered via a mechanical movement. For example, when the distal portion 12 of light 10 is extended and light 31 is exposed, switch S2 is activated. However, the light source 31 would not turn on until S1 is also activated. In this arrangement, when the flashlight 10 is in a closed configuration, light 31 cannot ever be activated because switch S2 is open. In one aspect, S1 is a variable voltage switch (e.g., an internal potentiometer) which could allow for dimming of any of the plurality of light sources.

Figure 5:
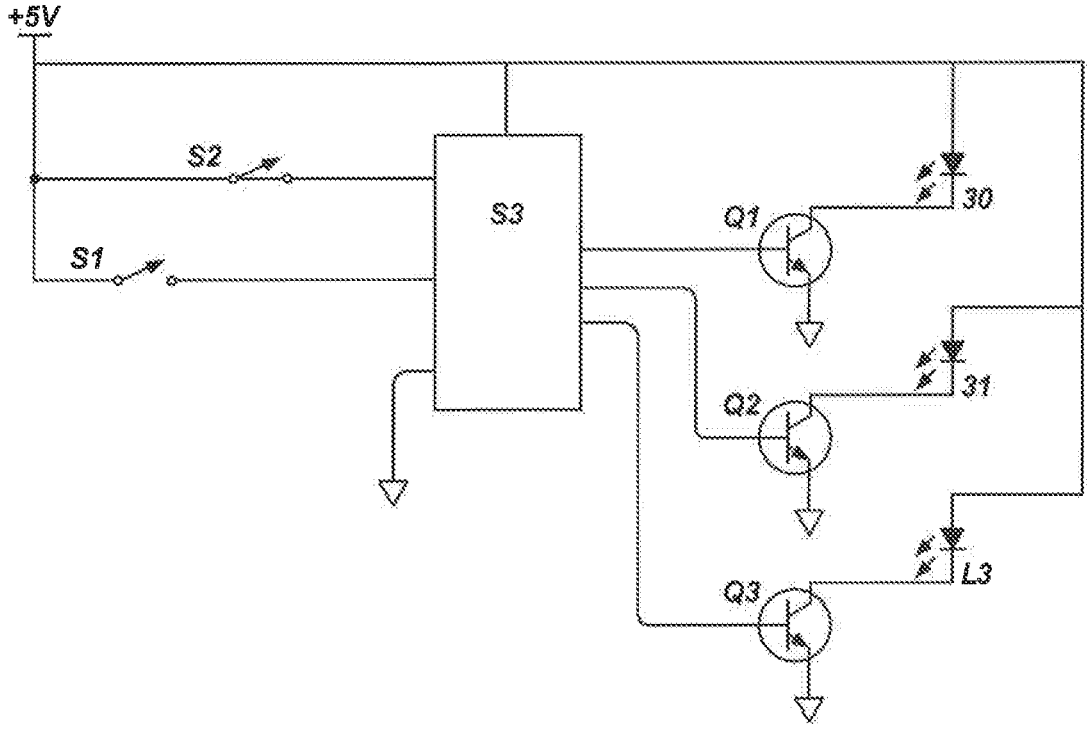
FIG. 5 is an electrical schematic of a system used in connection with a lighting device in accordance with one aspect of the technology.

FIG. 5 discloses an additional aspect of the technology using a microprocessor to support the mechanical switches 32 and 33, but with an additional control via software controlled (S3) switches that are part of the output control ports in the microprocessor. The software allows the manufacturer of the flashlight 10 to make any of the switches subject to the other, and by activating the "TRY ME" feature upon application of power during product assembly (for example), the flashlight 10 functionality can be configured to support an open reveal assembly without activating the light(s), and giving the potential purchaser of the product an opportunity to activate all of the different lights of the flashlight 10 when it is in an open configuration without the risk of completely depleting the batteries within the flashlight 10. In one aspect of the technology, a flashlight 10 uses an auto-on feature for the lighting element that is concealed by the reveal shroud 5. In that case, when the shroud 5 is extended and the flashlight 10 is in an open configuration (e.g., as shown in FIG. 2), switches S2 and S3 are needed to activate the lighting source 31, and S1 is used to cycle between a plurality of lighting options that may be part of the revealed lighting source (white work light, red map light, etc.).

Figure 6:
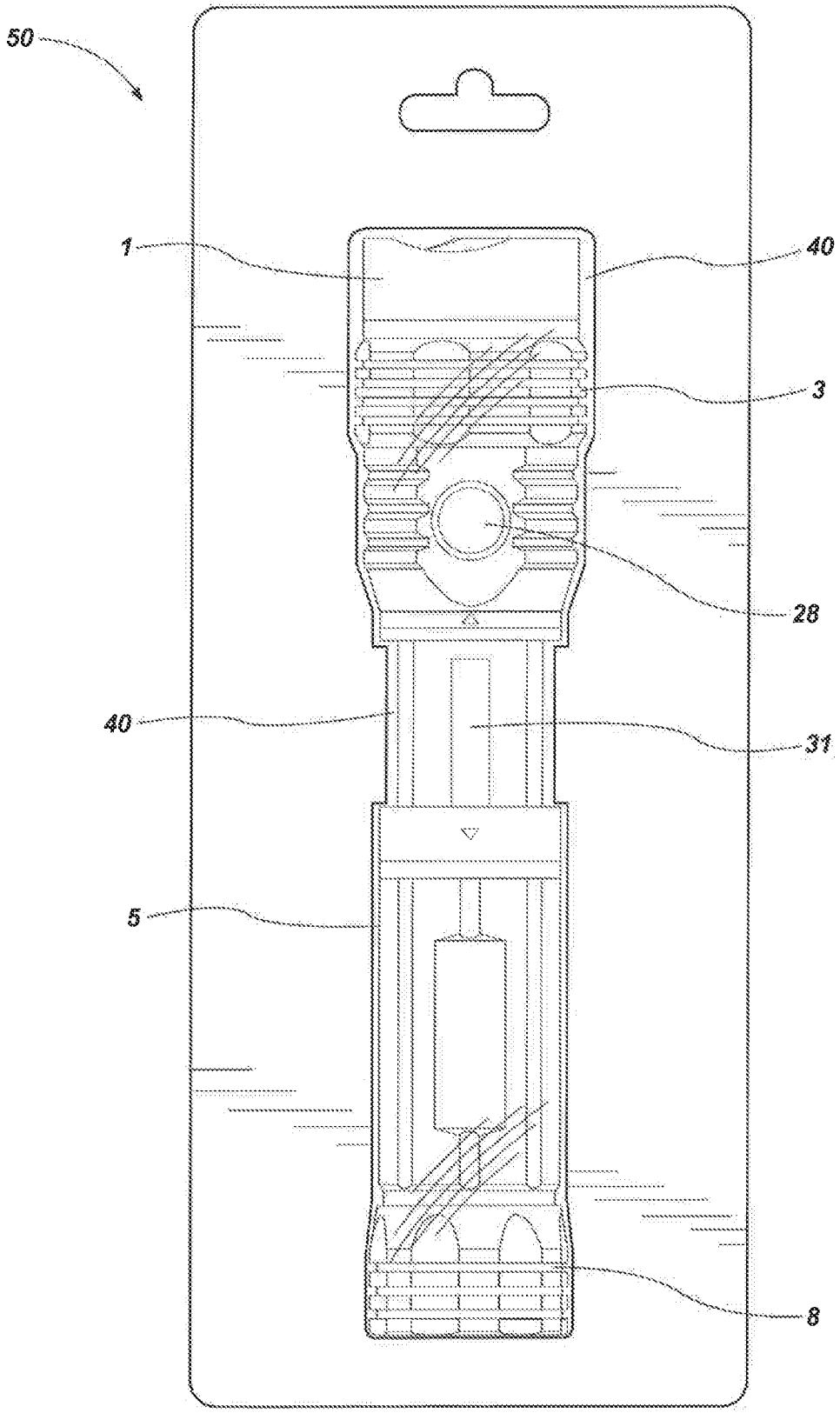
FIG. 6 is a view of an extendable flashlight in fixed packaging in accordance with one aspect of the technology.

FIG. 6 shows a rigid or semi-rigid enclosure 40 about an exterior of the flashlight 10 securing the flashlight 10 in a second configuration where both the forward directed, and always open or revealed light 30, and the light 31, which is covered in a first configuration, are each uncovered or open. In one aspect of the technology, packaging 50 includes multiple components that operate with enclosure 40. For example, packaging 50 may include a cardboard component that couples to a plastic clam shell enclosure. In another aspect, however, the entire package 50 may be plastic and may be integrally formed with the enclosure 40 that secures the flashlight 10 in its second configuration. The flashlight 10 is secured within the rigid or semi-rigid enclosure 40 in such a manner that a potential customer may not move the flashlight 10 into the first configuration (i.e., where the light 31 is covered) without first removing the flashlight 10 from the enclosure 40 or breaking the enclosure 40 in some manner. In one aspect of the technology, a least a portion of the enclosure 40 is translucent so that a potential purchaser may view the product and test the product within packaging 50. More specifically, in one aspect, the enclosure 40 about the first light source 30 and/or second light source 31 is translucent. An opening is present about the power switch 28. In another aspect, the enclosure 40 comprises an opening about the first light source 30 and/or the second light source 31.

While specific reference is made herein to light source 30 and 31, it is understood than more than two light sources may be used in connection with the light device. For example, a plurality of light sources may be disposed about the distal end 12 of the flashlight. A first "forward facing" light (i.e., the LED or other source propagating light in parallel with the longitudinal axis of the lighting device) may comprise a spot light configuration and a second forward facing light may comprise an annular LED or other light configured as an area light. The lighting device may further comprise more than one light source that are covered when the lighting device is in the first configuration. More specifically, reference is made herein to a second configuration where the covered light is exposed. However, the lighting device can comprise a second configuration where a second light covered in the first configuration is uncovered and further comprises a third light that remains covered in the second configuration. The lighting device may also comprise a third configuration where the second and third lights are both exposed or the second light remains covered and the third light is exposed or uncovered. In that aspect, one or more additional switches would be incorporated into the physical structure of the lighting device about the shroud to activate the different lights when the lighting device is in the second or third configuration.

Aspects of the technology also include a method of packaging a flashlight 10 that is equipped with one or more switches to operate the light in an open configuration. The method comprises obtaining a lighting device 10, said lighting device being enclosed in a removable rigid or semi-rigid enclosure. The lighting device 10 comprises a first configuration wherein a first light source 30 is exposed and a second light source 31 is covered and a second configuration wherein the first light source 30 is exposed and the second light source is also exposed 31. The removable rigid or semi-rigid enclosure secures the lighting device in the second configuration so that the second light source 31 is exposed. The lighting device 10 further comprises a power source coupled to the first and second light source and a switch (S1, S2, or S3) coupled to the first and second light sources and the power source. The switch is configured to permit propagation of power from the power source to the first and second light source. The method comprises activating the switch to provide power to the second light source while the lighting device is within the removable rigid or semi-rigid enclosure and activating the switch to provide power to the first light source while the lighting device is within the removable rigid or semi-rigid enclosure. In one aspect, the method further comprises removing the lighting device from the enclosure and moving the lighting device into the first configuration. In this aspect, the switch is configured to permit power to propagate from the power source to the second light source only when the lighting device is in the second configuration.

The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications or changes, if any, are intended to fall within the scope of the present technology as described and set forth herein.

More specifically, while illustrative exemplary aspects of the technology have been described herein, the present technology is not limited to these aspects, but includes any and all aspects having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

The invention claimed is:

1. A system, comprising:

a lighting device having (i) a first configuration wherein a first light source is exposed and a second light source is covered and (ii) a second configuration wherein the first light source is exposed and the second light source is exposed;

an enclosure removably disposed about a portion of an exterior of the lighting device securing the lighting device in the second configuration;

a power source electrically coupled to the lighting device to provide power to the first light source and the second light source; and a switch coupled to the power source and the first and second light sources configured to permit propagation of power from the power source to the second light source when the lighting device is in the second configuration.

2. The system of claim 1, wherein the switch is further configured to permit propagation of power from the power source to the first light source when the lighting device is in the first configuration.

3. The system of claim 1, further comprising a second switch that is disposed between the power source and the first switch and is activated by a controller disposed about an exterior of the lighting device.

4. The system of claim 1, wherein the lighting device comprises a flashlight having a longitudinal length, the first light source being disposed about a distal end of the flashlight and the second light source being disposed within a shroud when the lighting device is in a first configuration.

5. The system of claim 4, wherein the lighting device is placed in the second configuration by extending the shroud of the lighting device about a longitudinal axis of the lighting device.

6. The system of claim 1, wherein the first light source is configured to propagate light in a direction that is parallel to a longitudinal axis of the lighting device.

7. The system of claim 1, wherein the second light source is configured to propagate light in a direction that is normal to a longitudinal axis of the lighting device.

8. The system of claim 1, wherein the second light source is configured to propagate light about a perimeter of the light device in a direction that is normal to a longitudinal axis of the lighting device.

9. A system for operating a lighting device, comprising:

a hand-held lighting device having (i) a first configuration wherein a first light source disposed about a distal end of the lighting device that is exposed and a second light source is covered and (ii) a second configuration wherein the first light source is exposed and the second light source is exposed;

wherein the direction of light propagated from the first light source is different than the direction of light propagated from the second light source;

an enclosure removably disposed about an exterior portion of the lighting device, wherein the enclosure secures the lighting device in the second configuration;

a power source electrically coupled to the lighting device to provide power to the first light source and the second light source; and a switch electrically coupled to the power source and the first and second light sources, wherein the first switch is activated to permit propagation of power from the power source to the second light source at least when the lighting device is in the second configuration and is activated to permit propagation of power from the power source to the first light source at least when the lighting device is in the first configuration.

10. The system of claim 9, further comprising a second switch coupled to the power source and the first and second light sources, wherein the second switch is activated by a manual control disposed about a distal end of the lighting device.

11. The system of claim 9, further comprising a third switch electrically coupled to the first and second switches, wherein the third switch is a programmable switch.

12. The system of claim 11, wherein the third switch is coupled to the first light source, the second light source and a third light source.

13. The system of claim 11, wherein a portion of the enclosure is translucent.

14. The method of claim 13, further comprising activating the switch to provide power to the first light source while the lighting device is within the removable enclosure.

15. The method of claim 13, further comprising removing the lighting device from the enclosure and moving the lighting device into the first configuration.

16. The method of claim 13, wherein the switch is configured to permit power to propagate from the power source to the second light source only when the lighting device is in the second configuration.

17. The system of claim 11, wherein a portion of the enclosure about the second light source is translucent.

18. The system of claim 11, wherein the enclosure comprises an opening about the first light source or the second light source and about a power button coupled to the first switch.

19. The system of claim 11, wherein the enclosure comprises an opening about the first light source and the second light source.

20. A method of operating a lighting device, comprising:

obtaining a lighting device, said lighting device enclosed in a removable enclosure, the lighting device comprising a first configuration wherein a first light source is exposed and a second light source is covered and a second configuration wherein the first light source is exposed and the second light source is exposed, wherein the removable enclosure secures the lighting device in the second configuration, wherein the lighting device further comprises a power source coupled to the first and second light source and a switch coupled to the first and second light sources and the power source, said switch configured to permit propagation of power from the power source to the first and second light source; and activating the switch to provide power to the second light source while the lighting device is within the removable enclosure.

* * * * *